US007814724B2

(12) United States Patent
Zoli, III

(10) Patent No.: US 7,814,724 B2
(45) Date of Patent: Oct. 19, 2010

(54) METHOD FOR BUILDING OVER AN OPENING VIA INCREMENTAL LAUNCHING

(75) Inventor: Theodore Peter Zoli, III, Jersey City, NJ (US)

(73) Assignee: HNTB Holdings Ltd., Kansas City, MO (US)

( * ) Notice: Subject to any disclaimer, the term of this patent is extended or adjusted under 35 U.S.C. 154(b) by 10 days.

(21) Appl. No.: 12/248,599

(22) Filed: Oct. 9, 2008

(65) Prior Publication Data

US 2009/0094904 A1 Apr. 16, 2009

Related U.S. Application Data

(60) Provisional application No. 60/978,622, filed on Oct. 9, 2007.

(51) Int. Cl.
*E04B 1/00* (2006.01)
*E04G 21/00* (2006.01)
*E04G 23/00* (2006.01)

(52) U.S. Cl. ..... 52/745.06; 52/83; 52/223.1; 14/73; 14/77.1

(58) Field of Classification Search ..... 52/5, 52/6, 83, 223.6, 223.7, 223.8, 223.9, 223.11, 52/223.13, 223.14, 231, 291, 342, 745.05, 52/745.06, 745.08, 747.1; 14/18, 19, 20, 14/22, 73, 77.1; 404/35
See application file for complete search history.

(56) References Cited

U.S. PATENT DOCUMENTS

| | | | | | |
|---|---|---|---|---|---|
| 2,184,137 | A | * | 12/1939 | Brewer | 52/223.7 |
| 3,381,424 | A | * | 5/1968 | Butler | 52/83 |
| 3,559,361 | A | * | 2/1971 | Sarros | 52/742.14 |
| 4,442,149 | A | * | 4/1984 | Bennett | 428/53 |
| 4,694,629 | A | * | 9/1987 | Azimi | 52/611 |
| 5,920,938 | A | * | 7/1999 | Elcock et al. | 14/77.1 |
| 5,946,872 | A | * | 9/1999 | Pardo | 52/437 |

* cited by examiner

*Primary Examiner*—Richard E Chilcot, Jr.
*Assistant Examiner*—Theodore Adamos
(74) *Attorney, Agent, or Firm*—Shook, Hardy & Bacon L.L.P.

(57) ABSTRACT

Methods and systems for building a stress ribbon structure over an opening via incremental launching are disclosed. Temporary support structures are constructed adjacent to a permanent support structure. The stress ribbon structure is constructed in a staging area and in sections that are suspended between the temporary support structures. Anchorage panels at each end of a section engage a blister on the temporary and permanent structures. This arrangement allows completed sections to be launched from the temporary support structure onto and along the permanent support structure. Sections are individually constructed and launched and adjacent sections abut along a lateral edge. Adjacent sections are aligned by adjusting tension in integral support cables and their ends pivot or rotate about the blisters via a bearing system with both rotational flexibility and low friction to support sliding in the direction of launching.

19 Claims, 8 Drawing Sheets

METHOD FOR BUILDING OVER AN OPENING VIA INCREMENTAL LAUNCHING

CROSS-REFERENCE TO RELATED APPLICATIONS

This application claims the benefit of and priority to U.S. Provisional Application Ser. No. 60/978,622, filed on Oct. 9, 2007, which is hereby incorporated by reference in its entirety.

BACKGROUND

A stress ribbon, or stressed ribbon, is one of the simplest forms for long span structures and is based upon the iron chain bridge developed in Asia over 2000 years ago. A typical stress ribbon bridge is constructed with the use of high strength steel cables or tendons, typically in the form of pre-stressing strands between two upright support structures. The deck for stress ribbon structures is typically reinforced concrete, but may be any structural system that is capable of resisting compression forces and has adequate axial stiffness. Initially, the deck system is suspended from the cable system in an unstressed state, though the weight of the deck serves to add tension to the cable system. Subsequently, the steel cables or tendons are tensioned to put the deck system in a compressive state, thereby creating a prestressed (precompressed) structural system, with significantly increased stiffness beyond the cable system alone. It is noted that, given the plurality of cables in each section, some portion of the cables may be used to support the weight of the deck and are termed "bearing cables" and the remaining portions used to precompress the deck and are therefore termed prestressing cables.

Incremental launching is a construction technique that has been developed for construction of bridges in circumstances where lifting activities are restricted or impossible, e.g., in circumstances where the structure is too high (such as a bridge spanning a deep valley or gorge) or where a busy highway or rail corridor is spanned and interruption of traffic represents a severe inconvenience. Through incremental launching, a portion, or segment, of the structure is constructed in a fixed location and pushed, or launched, over the feature to be spanned. During construction, the partially completed structure has to function as a cantilever resulting in increased load demands over those required in the final configuration, where the structure is supported at both ends. This typically requires a structure of increased depth and strength in order to meet the additional load demands during construction. Such structures must be, on average, 20% to 30% stronger and somewhat more costly as compared to conventional construction.

BRIEF SUMMARY

The present invention generally relates to methods and systems for building over an opening via a combination of stress ribbon and incremental launching techniques. Temporary structures are constructed in a staging area adjacent to a permanent structure. Construction activities are generally restricted to the staging area, thereby decreasing construction and equipment costs, and increasing safety in the area within the opening over which a structure is to be built. The structure is built in sections which are subsequently incrementally launched from the temporary support structures of the staging area to the permanent structure and over the opening. Multiple sections are abutted together to form the structure. One or more topping layers may be applied to the top of the structure.

Additional objects, advantages, and novel features of the invention will be set forth in part in the description which follows, and in part will become apparent to those skilled in the art upon examination of the following, or may be learned by practice of the invention.

BRIEF DESCRIPTION OF THE SEVERAL VIEWS OF THE DRAWING

The present invention is described in detail below with reference to the attached drawing figures, wherein.

DETAILED DESCRIPTION

Figure 1:
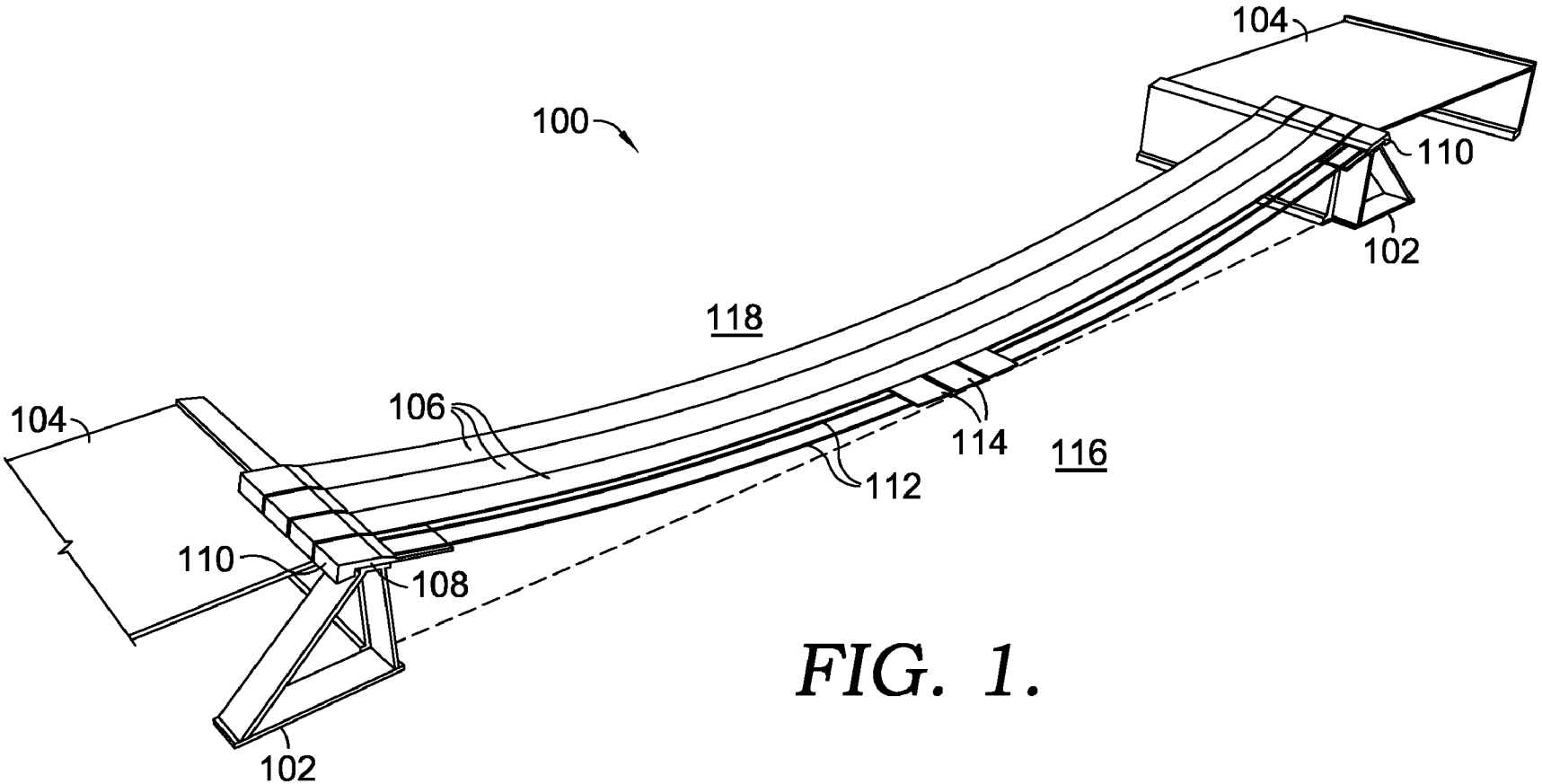
FIG. 1 is a perspective view of an incrementally launched stress ribbon section according to an embodiment of the present invention.

The subject matter of embodiments of the present invention is described with specificity herein to meet statutory requirements. However, the description itself is not intended to limit the scope of this patent. Rather, the inventor has contemplated that the claimed subject matter might also be embodied in other ways, to include different steps or combinations of steps similar to the ones described in this document, in conjunction with other present or future technologies. Moreover, although the term "step" may be used herein to connote different elements of methods employed, the term should not be interpreted as implying any particular order among or between various steps herein disclosed unless and except when the order of individual steps is explicitly described. Further, the inventor has contemplated that the variations in construction sites and practices are numerous and that the claimed subject matter may be embodied in practices utilizing machinery, materials, and construction methods not described specifically herein, but that would be recognized by one of skill in the art as equivalents.

Embodiments of the present invention provide methods and systems for building over an opening via a combination of stress ribbon and incremental launching technologies. In one aspect, a method for building over an opening is described. A pair of temporary support structures for supporting a stress ribbon section are prepared. The stress ribbon section comprises at least two anchorage panels, a plurality of cables and a plurality of prefabricated deck panels. The stress ribbon section is constructed by locating the anchorage panels on the support structures, installing the plurality of cables across the opening, wherein the cables are connected to and span between the anchorage panels, and installing the plurality of prefabricated deck panels on the plurality of cables. The cables are then tensioned and the stress ribbon section is then moved or launched sideways over the opening.

In another aspect, a system for incrementally launching a stress ribbon structure over an opening is disclosed. The system comprises a plurality of stress ribbon sections each comprising, two anchorage panels, a plurality of cables, and a plurality of prefabricated deck panels. Temporary support structures for supporting each end of a stress ribbon section, and a permanent support structure for supporting the stress ribbon structure are also components of the system. The plurality of stress ribbon sections are constructed by locating an anchorage panel on each temporary support structure, installing the plurality of cables across an opening between the anchorage panels, installing the plurality of prefabricated deck panels on the plurality of cables, and tensioning one or more of the plurality of cables. The stress ribbon section is subsequently launched in a direction transverse to its length onto the permanent support structure, and the plurality of stress ribbon sections abut along lateral edges to form the stress ribbon structure.

In yet another aspect, a method for building a stress ribbon structure over an opening via incremental launching is disclosed. A permanent support structure for supporting the stress ribbon structure is provided, and temporary support structures are constructed in a staging area adjacent to the permanent support structure, the temporary support structure being capable of supporting each end of a section of the stress ribbon structure. A plurality of sections are prepared by locating anchorage panels on each temporary support structure, installing a plurality of cables between the anchorage panels, wherein each cable further comprises a plurality of strands, and installing a plurality of prefabricated deck panels on the plurality of cables. The section is launched in a direction transverse to the length of the section and abuts adjacent sections. One or more of the plurality of strands in the plurality of cables are tensioned prior to launching, after launching, or both prior to and after launching, and one or more topping layers are applied.

Referring initially to FIG. 1, a portion of an incrementally launched stress ribbon structure 100 is depicted. Temporary support structures 102 are erected adjacent to permanent structures 104. As illustrated, three launched stress ribbon sections 106 are supported on the permanent structures 104 while an unlaunched and under construction stress ribbon section 108 is supported on the temporary support structures 102. Both the launched and unlaunched stress ribbon sections 106 and 108 are constructed with anchorage panels 110, a plurality of cables 112, and a plurality of deck panels 114.

The temporary support structures 102 may be constructed in any design or configuration capable of supporting each end of an unlaunched stress ribbon section 108 and may have a foundation system (deep or shallow) capable of resisting the forces associated with stress ribbon construction, or may employ other desirable construction techniques. The temporary support structures 102 must be capable of withstanding large horizontal forces in the direction of cables 112. The size and configuration of the temporary support structures 102 may be determined based on the size, weight, and other characteristics of the unlaunched stress ribbon section 108, but generally the length between temporary support structures matches the span of the stress ribbon structure 100, and the width of the temporary support structures is a function of the width of the section 108. Typically, the temporary support structures 102 are constructed to provide ease of removal upon completion of the stress ribbon structure 100, but may be constructed or retained as integral components of the permanent structure 104.

In one embodiment, the temporary support structures 102 are constructed from steel beams, welded, bolted, or riveted together in a generally right triangular format, as depicted in FIG. 1. A foundation system including compressing elements, such as drilled shafts, driven piles or spread footings (not shown), and tension elements, such as rock anchors (not shown), are used to anchor the temporary support structures 102 and provide a substructure system that is adequate to support all loads associated with the unlaunched sections 108.

With continued reference to FIG. 1, the temporary support structures 102 are constructed directly adjacent to the permanent structure 104 leaving very little, or no gap between them. The location adjacent to the permanent structure 104 is denoted as a staging area 116, and location of the temporary support structures 102 therein allows nearly all construction activities for erecting the stress ribbon structure 100 to be completed outside, or away from the permanent structure 104.

The permanent structure 104 is any structure, or structures, capable of supporting the stress ribbon structure 100. The permanent structure 104 may have any design, span, height, depth, or other characteristic for which a stress ribbon structure 100 can be constructed. As depicted herein, the permanent structure 104 may be such that the stress ribbon structure 100 provides a roof over an opening 118 outlined by the structure 104. In another embodiment the permanent structures may comprise bridge abutments for which a stress ribbon structure may comprise a bridge deck, among many other possible embodiments.

Again referring to FIG. 1, the launched sections 106 and the unlaunched section 108 are identical in construction except that the unlaunched section is currently supported by the temporary support structures 102 and the launched sections are supported by the permanent structure 104. Unlaunched sections 108 are constructed on the temporary support structures 102 and are then launched by pushing or pulling the section from the temporary support structure onto the permanent structure 104. The pushing or pulling may be completed by many methods including for example, but not limitation, winching and jacking. The launching of the unlaunched section 108 forces the section against launched sections 106, thereby moving all of the sections along the permanent structure 104 and away from the temporary support structures 102. Following launching, the unlaunched section 108 becomes a launched section 106 and another unlaunched section may be constructed on the temporary support structures 102.

Figure 2:
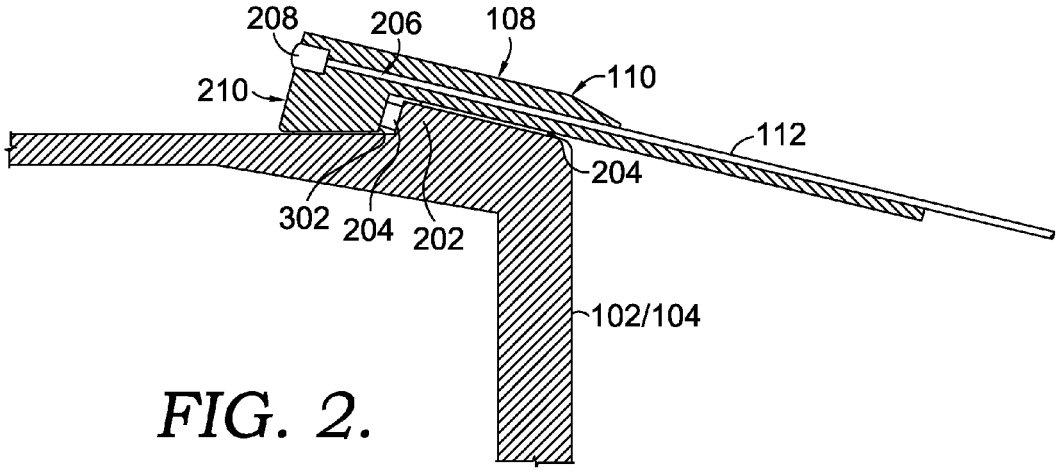
FIG. 2 is a side elevation view of one end of an incrementally launched stress ribbon structure according to an embodiment of the present invention.

Referring now to FIGS. 1 and 2, a blister 202 is depicted along a top surface of both the temporary support structure 102 and the permanent structure 104. The blister 202 is a raised feature located along the full length of the temporary support structure 102 and permanent structure 104 which engages the anchorage panels 110. The engagement retains the anchorage panels 110 by providing opposing surfaces between the blister 202 and the anchorage panel 110, thereby supporting the sections 106 and 108.

One or more bearings 204 may be inserted between the opposing surfaces of the blister 202 and the anchorage panel 110. The blister 202 surfaces are oriented such that they are aligned perpendicular to the final force in the stress ribbon structure 100, thereby minimizing the rotational demands on the bearings 204. The bearings 204 may be comprised of any suitable material, such as for example, but not limitation, Neoflon® or Kel-F® produced by Daiken Industries of Japan, or neoprene elastomeric compounds, which may be combined with a Teflon® sliding surface as manufactured by DuPont Corporation of Wilmington, Del., among others, and may allow the anchorage panels 110 to more easily slide along the blister 202 during incremental launching. The bearings 204 in conjunction with the blister 202 and anchorage panels 110 may also allow the anchorage panels 110 and therefore the sections 106 and 108 to rotate about the blister to a sufficient degree in order that bending stress in the stress ribbon structure 100 is minimized. The rotational freedom is principally oriented in the vertical direction and may be useful in aligning abutting sections 106 and 108, among other uses, as will be described in greater detail below.

Figure 3:
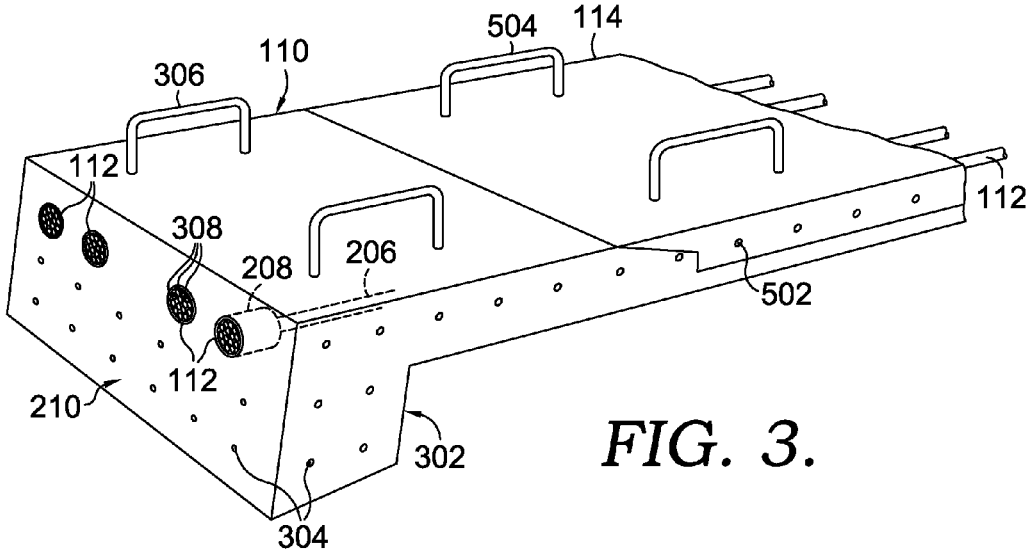
FIG. 3 is a perspective view of an anchorage panel according to an embodiment of the present invention.

With additional reference to FIG. 3, the anchorage panels 110 are located at each end of the sections 106 and 108. The anchorage panels 110 are designed to transfer the force from the sections 106 and 108 to the temporary support structure 102 and the permanent structure 104. The anchorage panels 110 provide a bearing surface 302 for engagement with the blisters 202 to retain the sections 106 and 108 in position and to allow movement of the sections during launching and alignment. The anchorage panels 110 may have any desired profile with a downward extending protuberance that provides the bearing surface 302 and proper engagement with the blister 202.

One or more cable ducts 206, are generally located within the anchorage panel 110 for inserting and installing one or more cables 112 through the anchorage panel 110 in the direction of the section 106 or 108 and securing the cables thereto. A plurality of cable anchorages 208 may be cast adjacent a face 210 of the anchorage panel 110. A cable anchorage system, such as a wedge-plate system, among others, is used to anchor the cables within the cable anchorage 208.

The anchorage panels 110 may be constructed from reinforced concrete or from any other suitable materials, or combinations thereof including metals, composites, or ceramics, among others. As depicted in FIG. 3, internal reinforcements 304 may be provided in any appropriate configuration and may extend from the anchorage panels 110 to engage adjacent sections 106 and 108 or as topping interface reinforcements 306 to serve as shear interface reinforcement and to provide for composite behavior with a topping material (described below).

The interface reinforcements 306 may be used to connect to and reinforce one or more topping layers (discussed below) applied to the top of the sections 106 or to the stress ribbon structure 100. The interface reinforcements 306 comprise shear transfer reinforcements, or stirrups which transfer forces between the sections 106 and any topping layers. Further, utilizing interface reinforcements 306 to connect to a topping layer may also provide integration, or connection of the sections 106 and 108 together. Interface reinforcements 306 may be of any shape, form or configuration compatible with the construction of the stress ribbon structure 100 and may comprise generally U-shaped sections of steel reinforcing bar, among others.

The cables 112 (also known as tendons) span between opposing anchorage panels 110 and support the deck panels 114. The cables 112 may comprise any structural element capable of resisting tension forces, such as, for example but not limitation, cable, chain, or rope, among others, suitable for application in the sections 106 and 108. As depicted in FIG. 3, the cables 112 may be further comprised of a plurality of strands 308 or wires. Utilizing cables 112 comprised of strands 308 provides the capability to tailor the tension in each cable by individually tensioning each strand 308 therein. Cables 112 of this form also offer the ability to replace individual strands 308 while the cables are in use supporting the structure.

Figure 4:
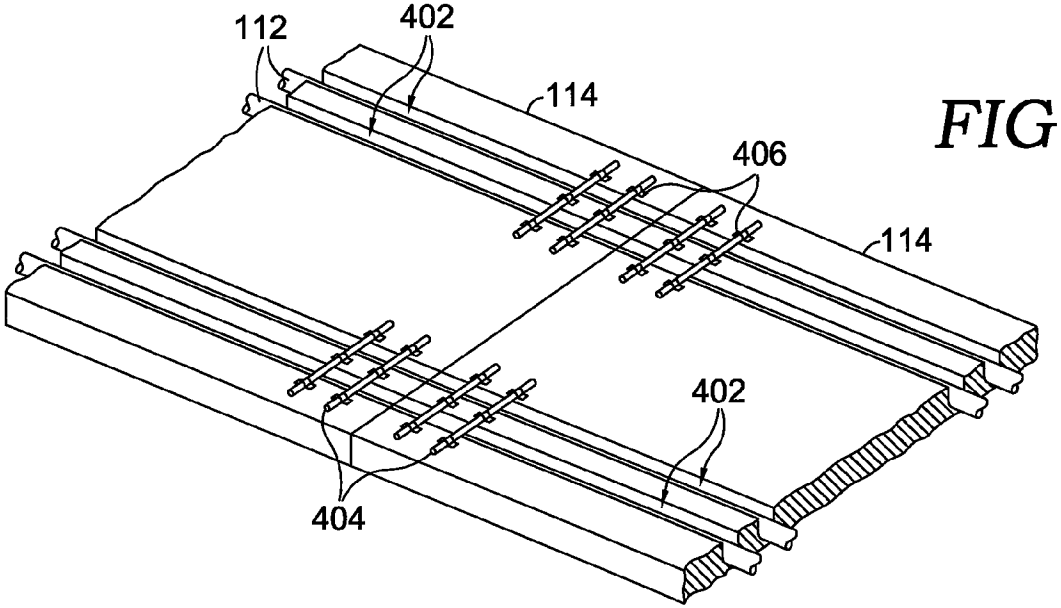
FIG. 4 is a perspective view of deck panels of a stress ribbon structure according to an embodiment of the present invention.
Figure 5A:
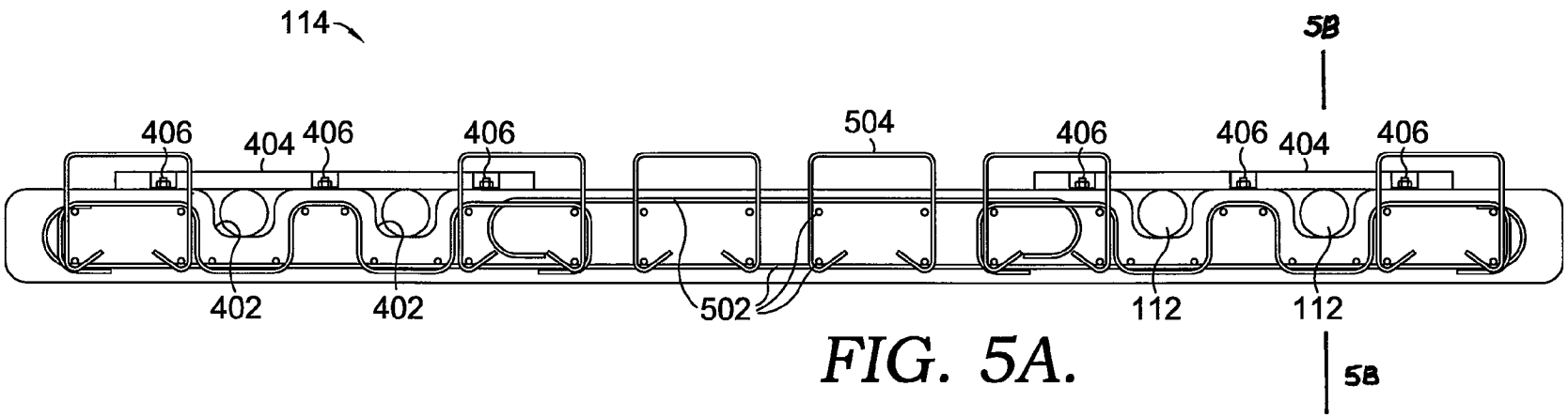
FIG. 5A is a transverse cross-sectional side elevation view of a deck panel according to an embodiment of the present invention.
Figure 5B:
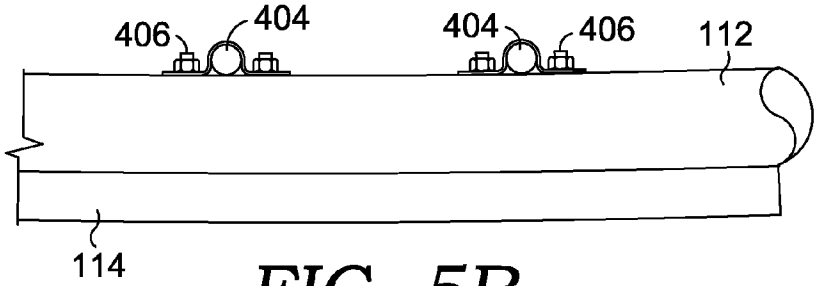
FIG. 5B is a cross-sectional side elevation view of the deck panel of FIG. 5A taken along the line 5B-5B.
Figure 6:
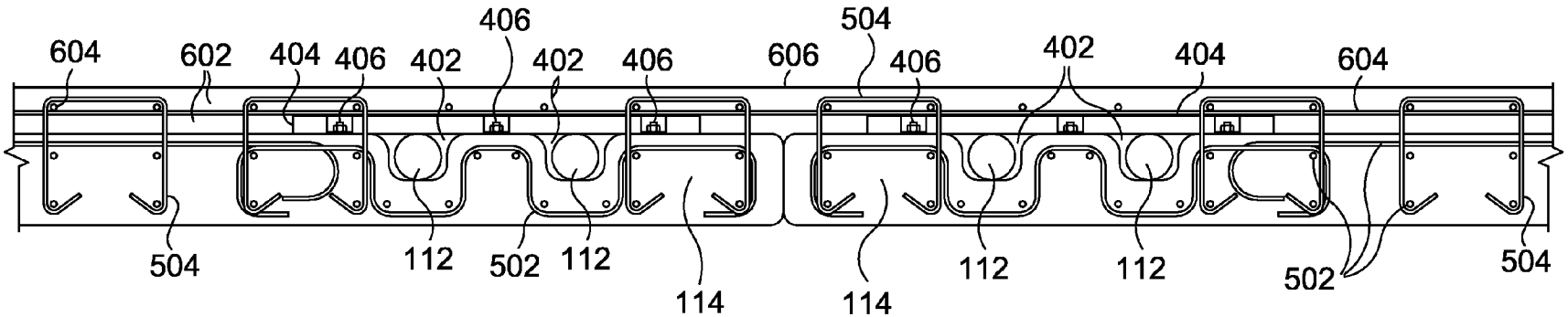
FIG. 6 is a transverse cross-sectional side elevation view of two deck panels of adjacent sections of a stress ribbon structure with topping layers according to an embodiment of the present invention.
Figure 7A:
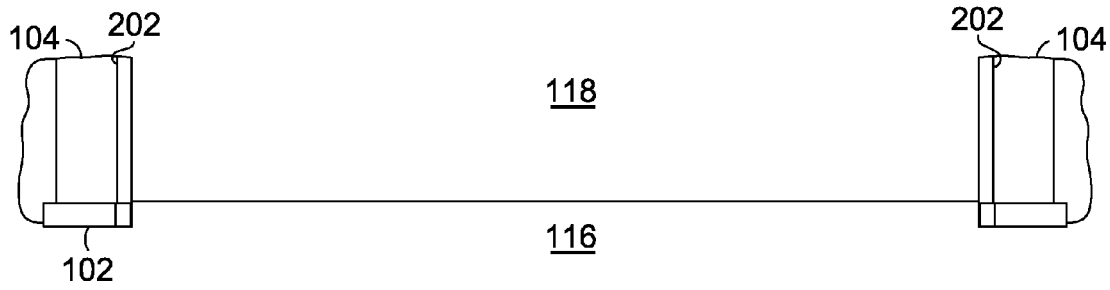
FIG. 7A is plan view of temporary structures, permanent structures, and an opening over which a stress ribbon structure is to be built according to an embodiment of the present invention.
Figure 7B:
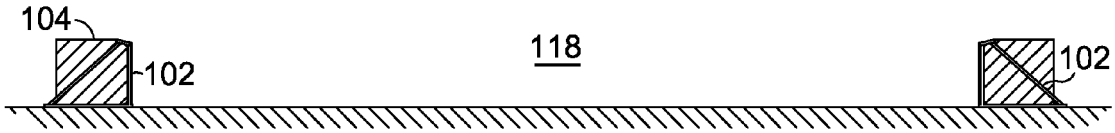
FIG. 7B is a side elevation view corresponding to FIG. 7A.

Referring now to FIGS. 4-6, the deck panels 114 of the stress ribbon structure 100 are depicted. The deck panels 114 are generally square or rectangular in overall shape, but may have any form, shape, or design suitable for construction of the stress ribbon structure 100. Such designs, may accommodate various toppings, such as, for example, but not limitation, concrete, asphalt, rubber, rock, or soil, among others. Designs are also conceivable that may aid in the installation of components or layers on the underside of the stress ribbon structure 100, such as, HVAC, electrical, plumbing, lighting, scaffolding, catwalks, overhead crane components, or moisture barriers, among others. The deck panels 114 may be constructed from any suitable materials capable of resisting compression forces and applicable for use in the stress ribbon structure 100, including, but not limited to, reinforced concrete, composites, and metals, among others.

The deck panels 114 may be pre-fabricated off site or may be fabricated as needed on the construction site. Any fabrication method may be utilized, including for example, a process of match casting in which deck panels 114 are cast from concrete using other adjacent deck panels as at least part of the casting mold. Such a process provides the added benefit of insuring proper fit between deck panels 114.

The deck panels 114 have a plurality of cable channels 402 cast, cut, or otherwise formed in the top surface of the panels for accepting a plurality of cables 112. The cable channels 402 run generally parallel to one another and extend the full dimension of the deck panel 114 in the direction of the stress ribbon section 108 into which the deck panel 114 will be incorporated. In other embodiments, the cable channels 402 may be located within the panel or along the underside of a deck panel 114.

A cable channel 402 generally has a width and depth sufficient to fully receive a cable 112 into the channel such that the top of the cable is at or below the top surface of the deck panel 114, as depicted in FIGS. 5A and B. The cable 112 may be retained within the cable channel 402 by a plurality of pins 404 inserted over the top of the cable channel and held in place by a plurality of tie down anchors 406. The pins 404 are typically round steel rods of sufficient diameter and material properties to support all, or a portion of the weight of a deck panel 114. The round shape of pins 404 allows the pins to roll along the top of the cables 112 to aid in moving the deck panels 114 along the cables. The tie down anchors 406 may be any component or fixture affixed to, or formed at or near the top surface of the deck panel 114 for accepting and retaining the pins 404. For example, the tie down anchors 406 may comprise steel tabs bolted to, or cast in the top surface of the deck panel 114 on adjacent sides of a cable channel 402. In other embodiments, for example the pins may have a non-circular cross-sectional shape and may be anchored to a deck panel without the use of tie down anchors 406.

In FIG. 5A a cross-sectional transverse side elevation view of a deck panel 114 depicts cables 112 located within the cable channels 402 and retained therein by pins 404 and tie downs 406. A plurality of internal reinforcements 502, as well as a plurality of topping interface reinforcements 504, are also depicted. The internal reinforcement 502 may comprise steel reinforcing bar or any other suitable components or materials for reinforcing the deck panel 114. The internal reinforcements 502 may also extend out of the deck panel 114 to provide one or more features for connecting deck panels or sections 106 together or for moving or manipulating the deck panels, among others.

As best depicted by FIG. 6, the topping interface reinforcements 504 extend from the top surface of the deck panel 114 and may be utilized to connect one or more topping layers 602 applied to the sections 106 or to the stress ribbon structure 100. The topping interface reinforcements 504 may extend into the deck panel 114 and engage one or more of the internal reinforcements 502 to aid in retaining the interface reinforcements 504 in the deck panel 114. Also as depicted in FIGS. 5A and 6, the topping interface reinforcements 504 may extend from the top surface of the deck panel as a stirrup, or generally U-shaped form, among a variety of other possible formations. Such topping interface reinforcements 504, may further be used as a location to which one may secure topping reinforcements 604, such as reinforcing bar, for reinforcing the topping layer 602. The topping reinforcements 604 may connect to, or intertwine with, the topping interface reinforcements 306 and may be placed parallel and/or transverse to the deck panels 114, as depicted in FIG. 6, or may be oriented in any other desired fashion. As such, the topping interface reinforcements 504 also provide shear transfer reinforcement between the sections 106 and 108 and any topping layers 602.

As described above, the topping layer 602 is generally comprised of concrete reinforced by the topping reinforcements 604 and topping interface reinforcements 306; however, it may also be constructed from asphalt, rubber, rock, or soil, among other possible materials. The one or more topping layers 602 may be applied by multiple methods and by a variety of sequences. The topping layer 602 may be applied to an unlaunched section 108 or to one or more launched section 106. The topping layer 602 may be applied to individual sections 106 and 108, one at a time, to two or more sections at a time, to the entire stress ribbon structure 100 all at once, or any combination thereof. The stress ribbon structure 100 design and construction demands may determine how and when to apply the topping layers 602.

Additionally, the topping layer or layers 602 may be utilized to link the sections 106 together into a unified, composite structure by providing a continuous component across the plurality of sections 106. An additional layer or membrane 606 may be applied on top of the one or more topping layer 602 to provide a water barrier, reflective layer, chemical barrier, or corrosion inhibiting layer, among many other possibilities.

With reference now to FIGS. 7-10, a method for building over an opening 118 via a combination of stress ribbon and incremental launching techniques is depicted according to an embodiment of the present invention. In FIGS. 7A and B, portions of a permanent structure 104 are shown along, and form opposite sides of, an opening 118. A staging area 118 is depicted outside and adjacent to the opening 116 and the permanent structures 104. Temporary support structures 102 are erected adjacent to the permanent structures 104 and in the staging area 116. Very little, or no space is left between the portions of the temporary support structure 102 and the permanent structure 104 that form the blister 202 in order to provide a continuous surface along which the sections 108 may be launched.

Figure 8A:
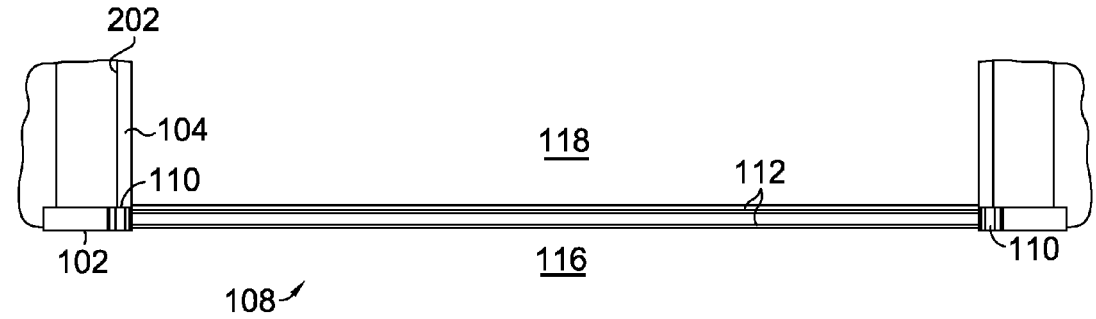
FIG. 8A is a plan view of anchorage panels and cables of a stress ribbon section spanning across the opening according to an embodiment of the present invention.

In FIGS. 8A and B, anchorage panels 110 are placed on each of the temporary support structures 102 and, in this embodiment, four cables 112 are installed between the anchorage panels. The cables 112 are inserted into the cable ducts 206 (see FIG. 3) of the anchorage panels 110 and are fixed within the cable anchorages 208. A hydraulic jacking system is used to achieve an initial tension and adjust the sag in the cables 112 by applying a prescribed tension force on individual strands 308 of the cables and to fix the position of the cable within the anchorage 208 with the use of individual strand wedges (not shown), among other anchorage systems. Cables may be prefabricated from individual strands 308 into a complete system and inserted into the cable duct 206, or may be installed strand by strand 308 using a winch and a messenger cable shuttle system with the cable duct 206 as the conduit for strand installation.

Figure 8B:
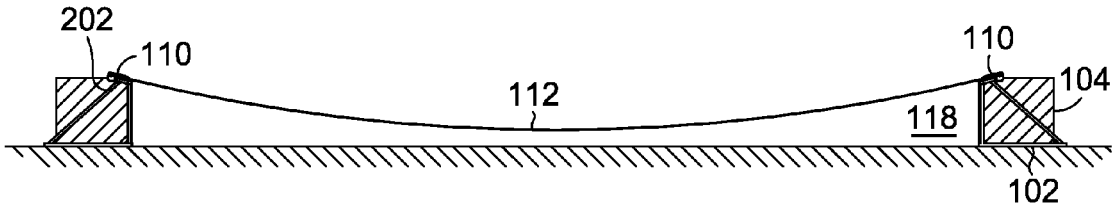
FIG. 8B is a side elevation view corresponding to FIG. 8A.

The cables 112 hang between the anchorage panels 110 in the shape of a Catenary arc, as depicted in FIG. 8B. A linear relationship exists between the tension on the cables 112 and the amount of sag in the cables. Therefore, the tension may be adjusted to produce a desired sag in the cables 112, and eventually in the sections 106 an 108. In other embodiments, the shape of the arc may also be altered by adding mass or weight at points along the arc causing the shape to deviate from the Catenary arc shape.

Figure 9A:
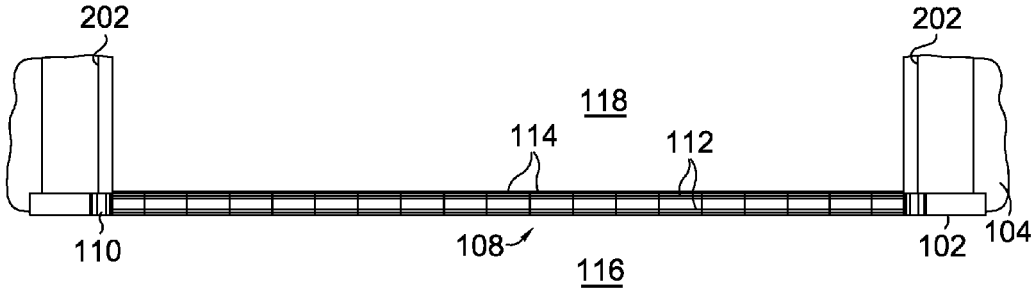
FIG. 9A is a plan view of deck panels being positioned on the cables of the stress ribbon section according to an embodiment of the present invention.
Figure 9B:
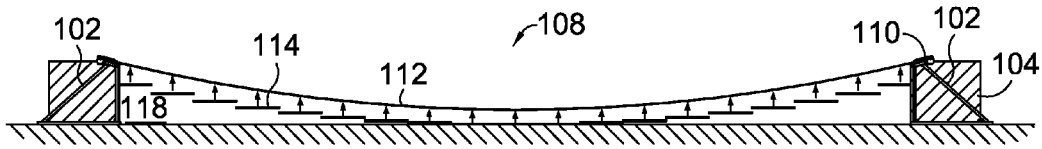
FIG. 9B is a side elevation view corresponding to FIG. 9A.

FIGS. 9A and B depict the installation of a plurality of deck panels 114 on the cable 112 in the staging area 116. Various methods may be utilized to install the deck panels 114. The deck panels 114 may be lifted up to the cables 112 by a crane, but other methods such as a pulley system that rides on top of the cables equipped with a hoist may also be used, among a variety of others. The deck panels 114 may be lifted into position at any point along the cables 112. The deck panels 114 may each be lifted at individual locations at which they will remain along the cables 112, or more than one deck panel may be lifted at a single location along the cables.

Once lifted to the cables 112, the deck panels 114 may be connected thereto by inserting each cable 112 into a respective cable channel 402 and then inserting a plurality of pins 404 over the cables and across the cable channels 402 (see FIGS. 4-6). The pins 404 may be held into position by tie down anchors 406 located on each side of the cable channels 402.

If more than one deck panel 114 is lifted at a single location along the cables 112 then, after each deck panel is connected to the cables, it may be pulled or pushed along the cables to its final location using a winch, hoist, or jacks, among other methods. Such a winch, hoist, or jack, among others, may be mounted on the temporary support structure 102, the permanent structure 104, or may be separate therefrom. The pins 404 may aid in moving the deck panels 114 into position by rolling or sliding along the cables 112. Grease or other lubricants may be applied to the cables 112 and pins 404 to further assist in the positioning. Further, depending on the location at which the panels 114 are connected to the cables 112, gravity may be used to move the panels 114 from their connection location toward the center of the cables 114.

With all of the deck panels 114 connected to the cables 112 and in the desired position, the cables may be tensioned in the same manner as described above using a hydraulic jack to tension each strand 308 individually, among other methods, such as loading the cables 112. One or more of the cables 112 may be drawn into tension to create compressive forces between the anchorage panels 110 and each of the deck panels 114 to pre-compress the panels. Placing the panels 110 and 114 in a compressed state causes the stress ribbon section 108 to become a more efficient structural system, because the system stiffness is predominated by unloading the precompression in the section 108, which is nearly constant precompression through the entire deck panel 114 and anchorage panel 110 system, instead of only the tension stiffness of the supporting cables 112. As such the section 108 has substantially more stiffness than the cable system supporting the weight of the precast panels, and is better at resisting additional loads, especially unbalanced loads. This system may have similar strength and stiffness as the final stress ribbon structure 100.

Additionally, each of the cables 112 or the individual strands 308 therein may be tensioned to different degrees. One or more of the cables 112 or strands 308 may be used as tensioning tendons to apply the compression for pre-stressing the panels 110 and 114 and the section 108. Conversely, one or more of the remaining cables 112 or strands 308 may be employed as bearing tendons which are imparted with a lesser degree of tension as compared to the tensioning tendons, and which aid in bearing the weight of the structure, among other purposes. It is noted that tensioning of the cables 112 may directly impact the geometry of the unlaunched section 108 and may introduce rotation at the bearings 204. As described previously, the bearings 204 may accommodate this rotation as well as provide an instrument for aiding in launching of the sections 108.

Figure 10A:
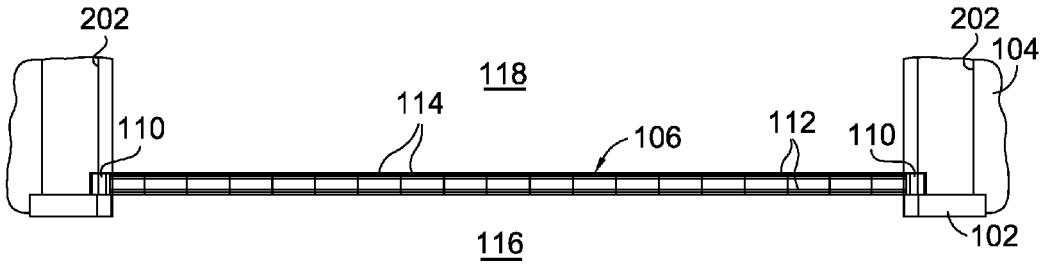
FIG. 10A is a plan view of a completed section of the stress ribbon section that has been launched transversely onto the permanent structures according to an embodiment of the present invention.
Figure 10B:
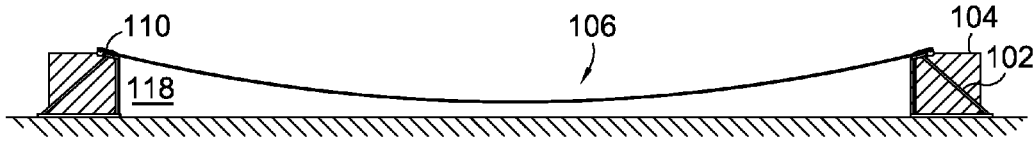
FIG. 10B is a side elevation view corresponding to FIG. 10A.

Referring now to FIGS. 10A and B, an unlaunched section 108 (depicted in FIGS. 9A and B) may be launched. The section 108 may be launched by pushing or pulling the section 108 sideways over the opening 118 with hydraulics, pneumatics, winches, hoists, or by another method. Generally, a force is applied at, or near each end of the section 108 along a lateral face of the anchorage panel 110. The force is applied in a direction parallel to the length of the blister 202 and generally transverse to the length of the section 108.

Figure 11:
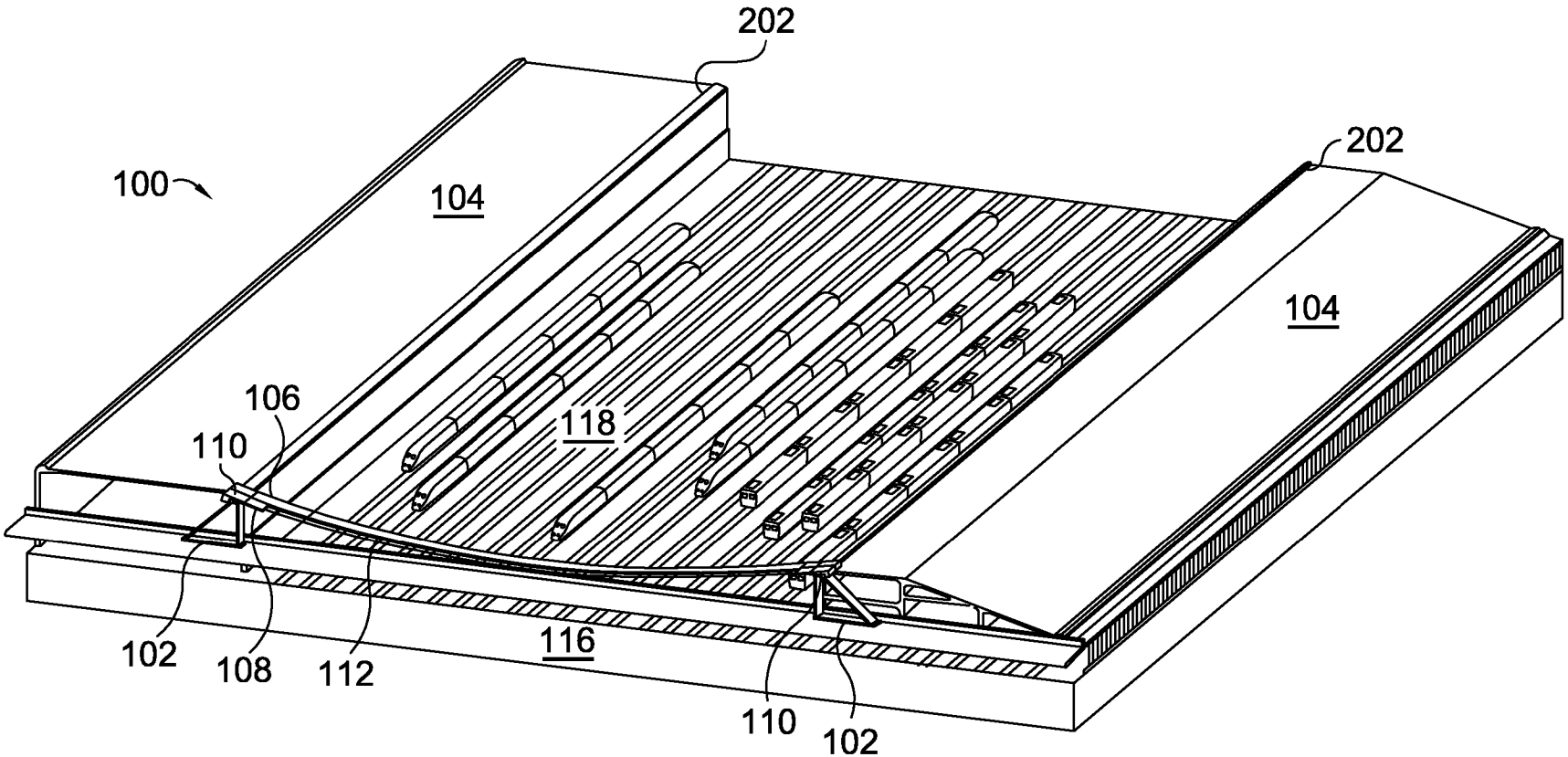
FIG. 11 is a perspective view of the stress ribbon structure according to an embodiment of the present invention having a completed, launched section and a second section under construction.

The bearing surfaces 302 (see FIG. 3) of the anchorage panels 110 slide along the bearings 204 placed between the bearing surfaces 302 and the blisters 202, thereby allowing the section 108 to move along the blisters 202 from the temporary support structures 102 to the permanent structures 104. The unlaunched section 108 thus becomes a launched section 106 and construction can begin on the next unlaunched section, as depicted in FIG. 11.

As subsequent sections 108 are launched they will abut previously launched sections 106 along their length and the launching process will cause the launched sections to move further along the blisters 202 and the permanent structure 104. The construction and launching processes are repeated until all sections 108 are launched.

Differences in the sag of adjacent sections 106 and 108 may be noticed before or after launching. The tension in the cables 112 and strands 308 may be adjusted to accommodate these differences and to adjust the sag of the sections. As stated previously, the sag has a linear relationship with the tension and therefore, the tension may be increased to reduce the sag of a section 106 or 108 or may be decreased to increase the sag. Further, the combination of the anchorage panels 110, blisters 202 and the bearings 204 allow the ends of the sections 106 and 108 to rotate about the blisters 22 and thereby allow the sag of the sections 106, 108 to be adjusted without damaging, reconstructing or adjusting the temporary support structures 102 or the permanent structure 104.

Sealants and glues, such as, for example but not limitation, epoxies, resins, fibers, fabrics, or rubber gaskets, among others, may be applied between sections 106 and 108 and between panels 110 and 114 prior to, or after launching. Such sealants and glues may aid in bonding the sections 106 and 108 and panels 110 and 114 together, and may serve to prevent leaks, among other uses.

Figure 12:
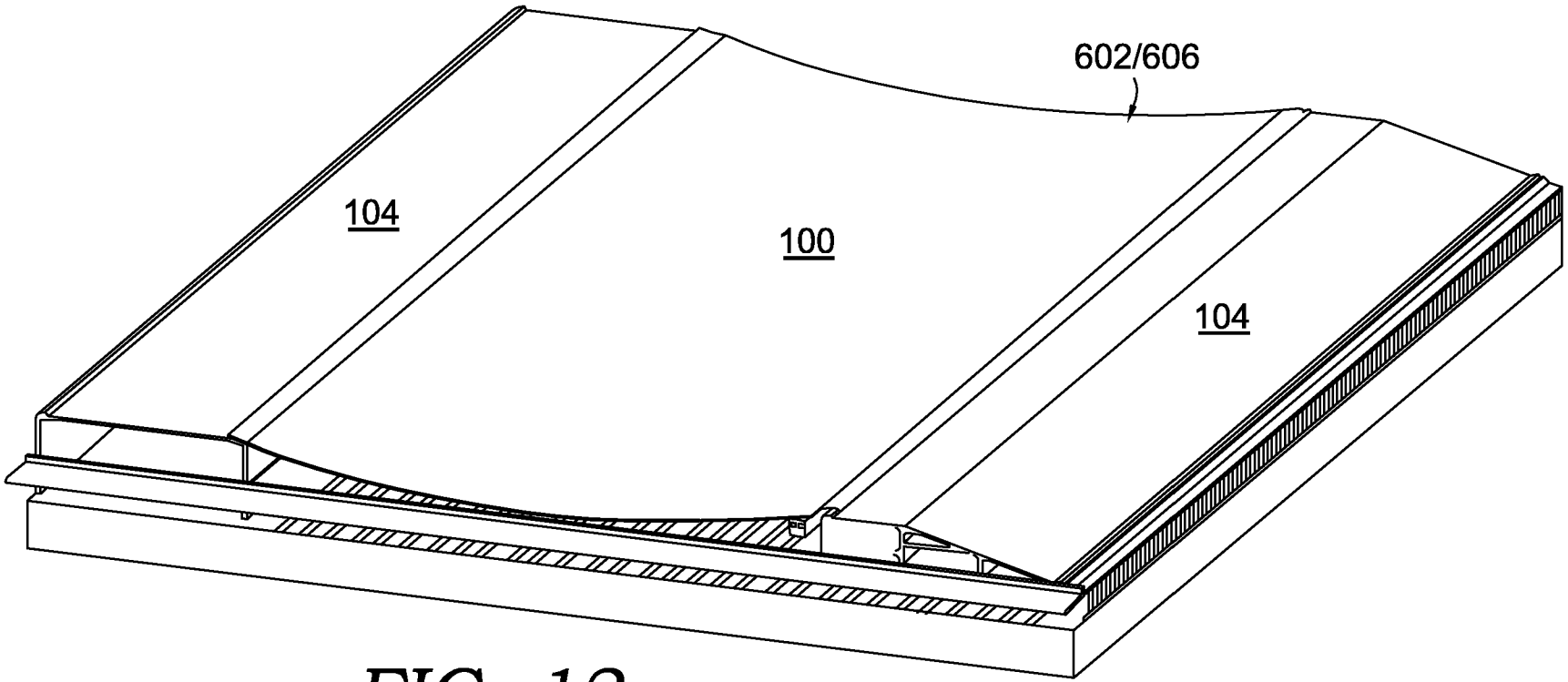
FIG. 12 is a perspective view of the completed stress ribbon structure according to an embodiment of the present invention.

Having launched all necessary sections 108, one or more topping layers 602 may be applied to the launched sections 106, as depicted in FIG. 12. Topping reinforcements 604 (see FIG. 6), such as, for example but not limitation, steel reinforcing bar, may be installed on the sections 106 and across sections to tie them together in any suitable manner, but generally are applied in a grid layout. The grid of topping reinforcements 604 may engage and intertwine with topping interface reinforcements 306 and 504 on the top of the anchorage panels 110 and deck panels 114 respectively, that comprise the sections 106. In the present embodiment, a topping layer 602 is comprised of concrete, but any other suitable material may be utilized as described previously.

The topping layer 602 may be applied in stages or to the entire structure 100 at once, as may be required by construction demands. Generally, the topping layer 602 is applied across one or more sections at a time such that seams between portions of the topping layer are staggered with seams between adjacent sections 106. Such a method minimizes seams or gaps that penetrate the depth of the structure and connects the sections 106 to one another.

Alternatively, topping layers 602 may be applied to individual sections 108 prior to launching or across one or more launched sections 106 prior to completion of all launching steps. Advantages for each of these methods exist, for example applying the topping layers 602 after completion of launching requires less force for launching due to the sections having less weight without the topping layer. Construction demands, costs, and design may determine the sequence of the steps.

Conversely, or in addition to one or more topping layers 602, a system of transverse post-tensioning may be utilized to link the sections 106 together. A series of cables or tendons, among a variety of other components, may be installed above, below and/or through the sections 106 in a manner that extends between two or more sections. Tension may be applied to the cables to draw the sections 106 together and to retain the sections in position.

After application of one or more topping layers 602, one or more membranes 606 may also be applied. The membranes 606 may comprise any suitable substance or structure for achieving the design and construction demands of the membrane, including for example, a rubber, plastic, composite or other material for providing a moisture barrier, among others.

An additional, tensioning process may be carried out after application of the one or more topping layers 602 or membrane 606. Such a process may be utilized to adjust the tension for changes in the weight of the structure 100 due to application of the toping layers 602 or membrane 606, or may be utilized to adjust the amount of compression and pre-stress the structure is under. Furthermore, the tension of the cables 112 and strands 308 may be adjusted throughout the life span of the structure 100.

Many variations in the sequence of steps, construction materials, equipment, and structure design are possible and necessary for tailoring aspects of present invention for use in the wide array of construction and design applications available. Construction demands, costs, equipment, and design, among other factors, may determine such variables to promote the many advantages of the present invention.

Such advantages may include the capability to lift deck panels 114 at a single location and then push or pull them into position. By such a method, only a single crane or lifting system need be provided, and it may not require relocation during construction. Also, the crane or lifting system may be advantageously located and oriented such that the smallest range of motion for lifting and placing the deck panels 114 is required. Additionally, the workflow of material may be more easily setup and processed because it can be based around the single lifting location. All such advantages may increase the efficiency of the worksite and decrease equipment costs by reducing the size and number of cranes, or other lifting apparatus, and the amount of worksite preparation and setup, among others. Further, the safety of the worksite may also be increased because the lifting activities may be contained within fewer and smaller areas.

Additional advantages of embodiments of the present invention include the capability for all, or nearly all, of the construction process to occur within the staging area 116. The cranes, or other lifting systems, and other materials, equipment, and personnel may be contained within the staging area 116. Further, as sections 108 are launched, they may be in a nearly completed state. The launched sections 106 or the partially completed stress ribbon structure 100 may have the same, or nearly the same strength, rigidity, safety, and fire safe characteristics, among other characteristics, as the fully completed stress ribbon structure. Thus, any activities, people, equipment, or otherwise that are located within the opening 118 may safely continue and remain within the opening during the construction process.

Additionally, the construction activities that must take place on top of the sections 106 may have increased safety with respect to the rigidity and completeness of the sections. Because the sections 106 have the same, or nearly the same, strength and rigidity characteristics as the completed structure 100 and because they comprise very few components, construction personnel and equipment may access the top of the sections 106 without the fears and dangers associated with other structures such as, falling through the structure, loose or missing components of the structure, and incomplete structural portions of a structure, among others.

In one embodiment of the present invention the stress ribbon structure may form a roof over a rail yard as depicted in FIGS. 11 and 12. The incrementally launched stress ribbon structure 100 may be well suited to such an application due to the advantages of launching over an opening comprising the rail yard without the necessity to halt rail traffic or activities in the rail yard during construction. Further, due to the great strength and flexibility that may be inherent in a design of the structure 100, very large spans may be achieved, as well as accommodation of various components above or below the structure, such as, for example, a park placed on top of the structure. Additionally, the rotational flexibility of the bearing 204 system at the anchorage segments 110 and the ability to alter the geometry of the structure 100 through tensioning may provide adaptability of the structure to various design concepts.

In another embodiment of the present invention the stress ribbon structure may comprise a bridge or roof structure to support pedestrian or vehicular traffic or wind, water, snow and ice loads. As described above, the adaptability of the stress ribbon structure and the capability to provide a stiff structural system for long uninterrupted spans may be very useful for such structures.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A method for building over an opening via incremental launching, the method comprising:

preparing a temporary support structure that supports at least two anchorage panels, a plurality of cables and a plurality of prefabricated deck panels of a single stress ribbon section;

locating the anchorage panels on the temporary support structure;

installing the plurality of cables across the opening, wherein the cables are connected to and span between the anchorage panels;

installing the plurality of prefabricated deck panels on the plurality of cables utilizing:

a plurality of channels located in a top surface of the prefabricated deck panels, and a plurality of pins, wherein the plurality of cables are inserted into the plurality of channels, the plurality of pins are inserted across the top of the channels, and over the cables, and wherein the prefabricated deck panels hang from the plurality of cables via the plurality of pins, and wherein the pins roll or slide on the plurality of cables, thereby allowing movement of the prefabricated deck panels along the length of the plurality of cables; and launching the stress ribbon section over the opening by sliding the anchorage panels from the temporary support structure to a permanent support structure.

2. The method of claim 1, wherein the stress ribbon section is launched over the opening in a direction transverse to the opening.

3. The method of claim 1, further comprising:

creating multiple stress ribbon sections;

abutting adjacent stress ribbon sections together; and linking adjacent stress ribbon sections together by transverse post-tensioning, creating a topping layer, or a combination of transverse post-tensioning and creating a topping layer.

4. The method of claim 1, wherein the prefabricated deck panels are installed on the plurality of cables at a single location and then drawn or pulled along the length of the plurality of cables to a final position.

5. The method of claim 1, wherein one or more of the plurality of cables is tensioned prior to launching, after launching, or both prior to launching and after launching.

6. The method of claim 5, wherein adjusting the tension in one or more of the plurality of cables is utilized to manipulate the shape of the stress ribbon section and thereby, to align the stress ribbon section with one or more adjacent stress ribbon sections or with an adjacent structure.

7. The method of claim 1 wherein, the permanent support structure includes a blister located along a top portion for engaging the anchorage panels.

8. The method of claim 7, wherein one or more bearings are placed between the blister and one or more bearing surfaces of the anchorage panel to aid in launching the stress ribbon section and to allow rotation of the anchorage panel.

9. A system for incrementally launching a stress ribbon structure over an opening comprising:

a plurality of stress ribbon sections further comprising, two anchorage panels, a plurality of cables extending therebetween, and a plurality of prefabricated deck panels coupled with the cables;

temporary support structures for supporting each end of a stress ribbon section;

a permanent support structure for ultimately supporting the stress ribbon structure; and a jack or winch for launching the plurality of stress ribbon sections by sliding each of the plurality of stress ribbon sections from the temporary support structures onto the permanent support structure;

wherein the plurality of stress ribbon sections are constructed by locating an anchorage panel on each temporary support structure, installing the plurality of cables across the opening between the anchorage panels, installing the plurality of prefabricated deck panels on the plurality of cables utilizing:

a plurality of channels located in a top surface of the prefabricated deck panels, and a plurality of pins, wherein the plurality of cables are inserted into the plurality of channels, the plurality of pins are inserted across the top of the channels, and over the cables, and wherein the prefabricated deck panels hang from the plurality of cables via the plurality of pins, and wherein the pins roll or slide on the plurality of cables, thereby allowing movement of the prefabricated deck panels along the length of the plurality of cables; and tensioning one or more of the plurality of cables;

wherein the stress ribbon section is launched in a direction transverse to the opening and onto the permanent support structure; and wherein, the plurality of stress ribbon sections abut along lateral edges to form the stress ribbon structure.

10. The system of claim 9, wherein the permanent structure and the temporary structures further provide a blister for engaging the anchorage panels.

11. The system of claim 10, wherein one or more bearings for assisting in launching of the stress ribbon sections and to allow rotation of the anchorage panels is located between the blister and one or more bearing surfaces of the anchorage panels.

12. The system of claim 9, wherein the tension in the plurality of cables is adjusted to manipulate the geometry of one or more of the plurality of stress ribbon sections in order to align abutting stress ribbon sections.

13. The system of claim 12, wherein the plurality of cables include a plurality of strands which are tensioned individually to provide one or more bearing tendons and one or more tensioning tendons.

14. The system of claim 9, wherein one or more topping layers is applied on top of the stress ribbon structure.

15. The system of claim 14, wherein the one or more topping layers comprises one or more of a reinforced concrete layer and a moisture barrier.

16. The system of claim 9, wherein the temporary support structures are located adjacent to the permanent structure in a staging area, and wherein the plurality of stress ribbon sections are constructed in the staging area.

17. The system of claim 16, wherein construction equipment for erecting the stress ribbon structure is located within a staging area adjacent to the permanent structure.

18. A method for building a stress ribbon structure over an opening via incremental launching, the method comprising:

providing a permanent support structure for supporting the stress ribbon structure;

constructing temporary support structures in a staging area adjacent to the permanent support structure, the temporary support structures capable of supporting each end of a section of the stress ribbon structure;

preparing a plurality of sections by:

locating anchorage panels on each temporary support structure;

installing a plurality of cables between the anchorage panels, wherein each cable further comprises a plurality of strands;

installing a plurality of prefabricated deck panels on the plurality of cables utilizing:

a plurality of channels located in a top surface of the prefabricated deck panels, and a plurality of pins, wherein the plurality of cables are inserted into the plurality of channels, the plurality of pins are inserted across the top of the channels, and over the cables, and wherein the prefabricated deck panels hang from the plurality of cables via the plurality of pins, and wherein the pins roll or slide on the plurality of cables, thereby allowing movement of the prefabricated deck panels along the length of the plurality of cables; and launching the section in a direction transverse to the opening;

abutting adjacent sections; and applying one or more topping layers on the sections; and tensioning one or more of the plurality of strands in the plurality of cables prior to launching, after launching, or both prior to and after launching.

19. The method of claim 18, wherein the temporary support structures and the permanent support structure provide a blister along an upper edge for engaging the anchorage panels, wherein one or more bearings are inserted between the blister and one or more bearing surfaces of the anchorage panels, and wherein, the one or more bearings allow rotational flexibility and launching of the sections.

* * * * *